US009000669B2

(12) United States Patent
Kuwahara et al.

(10) Patent No.: US 9,000,669 B2
(45) Date of Patent: Apr. 7, 2015

(54) MAGNETRON AND MICROWAVE UTILIZATION DEVICE

(75) Inventors: Nagisa Kuwahara, Shiga (JP); Etsuo Saitou, Shiga (JP); Takanori Handa, Shiga (JP); Takeshi Ishii, Shiga (JP)

(73) Assignee: Panasonic Intellectual Property Management Co., Ltd. (JP)

( * ) Notice: Subject to any disclaimer, the term of this patent is extended or adjusted under 35 U.S.C. 154(b) by 98 days.

(21) Appl. No.: 13/202,740

(22) PCT Filed: Dec. 24, 2009

(86) PCT No.: PCT/JP2009/007217

§ 371 (c)(1),
(2), (4) Date: Aug. 22, 2011

(87) PCT Pub. No.: WO2010/097882

PCT Pub. Date: Sep. 2, 2010

(65) Prior Publication Data

US 2011/0298373 A1 Dec. 8, 2011

(30) Foreign Application Priority Data

Feb. 27, 2009 (JP) ..... 2009-046643

(51) Int. Cl.
*H01J 25/50* (2006.01)
*H01J 25/587* (2006.01)
*H01J 23/12* (2006.01)

(52) U.S. Cl.
CPC ..... *H01J 25/587* (2013.01); *H01J 23/12* (2013.01)

(58) Field of Classification Search
CPC ..... H01J 23/12; H01J 25/50
USPC ..... 315/39.67, 39.51
See application file for complete search history.

(56) References Cited

U.S. PATENT DOCUMENTS 6,388,379 B1 * 5/2002 Makhov ..... 315/39.51
7,135,820 B2 * 11/2006 Shon et al. ..... 315/39.51
2003/0070922 A1 4/2003 Ishii et al.
2003/0090220 A1 5/2003 Aiga et al.

(Continued)

FOREIGN PATENT DOCUMENTS

CN 1404093 A 3/2003
CN 1417834 A 5/2003

(Continued)

OTHER PUBLICATIONS

International Search Report for International Application No. PCT/JP2009/007217, dated Feb. 9, 2010, 2 pages.

(Continued)

*Primary Examiner* — Alexander H Taningco
*Assistant Examiner* — David Lotter
(74) *Attorney, Agent, or Firm* — Brinks Gilson & Lione

(57) ABSTRACT

A magnetron includes an anode cylinder which has a cylindrical shape with both ends opened and which includes a plurality of vanes radially provided on an inner wall surface thereof, a pair of pole pieces positioned in openings of the both ends of the anode cylinder, and metal sleeves. The metal sleeves are positioned outside the pair of pole pieces and configured to air-tightly seal the anode cylinder. Each of the metal sleeves includes a cylinder part, a flange part continuous with the cylinder part, and a plurality of protrusions provided on a portion in which the cylinder part continues with the flange part.

5 Claims, 4 Drawing Sheets

(56) References Cited

U.S. PATENT DOCUMENTS

| | | | | |
|---|---|---|---|---|
| 2004/0113560 | A1* | 6/2004 | Brady | 315/39.51 |
| 2007/0139125 | A1* | 6/2007 | Baek et al. | 331/5 |
| 2008/0100220 | A1 | 5/2008 | Ishii et al. | |

FOREIGN PATENT DOCUMENTS

| | | | |
|---|---|---|---|
| CN | 101047095 | A | 10/2007 |
| CN | 101174532 | A | 5/2008 |
| EP | 1521288 | A2 | 4/2005 |
| JP | 60-117527 | A | 6/1985 |
| JP | 62-144048 | U | 9/1987 |
| JP | 1-173548 | * | 10/1989 |
| JP | 03-082551 | U | 8/1991 |
| JP | 04-167334 | A | 6/1992 |
| JP | 06-223727 | A | 8/1994 |
| JP | 2005-050572 | A | 2/2005 |

OTHER PUBLICATIONS

Extended European Search Report in corresponding European Application No. 09840736.4, dated Apr. 16, 2014, 5 pages.

* cited by examiner

MAGNETRON AND MICROWAVE UTILIZATION DEVICE

This application is a 371 application of PCT/JP2009/007217 having an international filing date of Dec. 24, 2009, which claims priority to JP2009-046643 filed on Feb. 27, 2009, the entire contents of which are incorporated herein by reference.

TECHNICAL FIELD

The present invention relates to a magnetron and a microwave utilization device, and particularly to the magnetron used in the microwave utilization device such as a microwave oven.

BACKGROUND ART

In a magnetron 90 disclosed in Patent Document 1, a metal sealing body 80 (hereinafter called a metal sleeve 80) is joined to an anode cylinder. FIG. 5 is a diagram showing the metal sleeve 80 of the magnetron 90 in related art. As shown in FIG. 5, the metal sleeve 80 includes a flange part 81 contacting a pole piece 84 (hereinafter called a pole piece 84), a cylinder part 82 continuous with the flange part 81, and a folded-back part 83 which continues from the cylinder part 82 and which is folded back inside the tube.

The cylinder part 82 includes a concentric first cylinder part 82*a*, a second cylinder part 82*b* having the same central axis as the central axis of the metal sleeve 80, and a taper part 82*c* continuous with the first cylinder part 82*a* and the second cylinder part 82*b*.

The first cylinder part 82*a* continues with the second cylinder part 82*b* through the taper part 82*c* in which an inside diameter changes gradually. An inside diameter $\phi 1$ of the first cylinder part 82*a* is smaller than an inside diameter $\phi 2$ of the second cylinder part 82*b*. Also, the inside diameter $\phi 2$ of the second cylinder part 82*b* of the metal sleeve 80 is formed in about the same dimension as an inside diameter D of a falling part of the pole piece 84.

Patent Document 1: JP-A-2005-050572

SUMMARY OF THE INVENTION

Problem to be Solved by the Invention

However, in the metal sleeve 80 of the magnetron 90 shown in FIG. 5, when the inside diameter of the cylinder part 82 is smaller than the inside diameter D of the falling part 84*a* of the pole piece 84 because of variations in manufacture, application of a high pressure in the case of handling or assembly of a microwave output part concentrates on the metal sleeve 80 and the cylinder part 82 of the metal sleeve 80 tends to sink in a recess of the pole piece 84. Then, there was a problem of degrading basic characteristics of the magnetron 90 when the cylinder part 82 of the metal sleeve 80 sinks toward the falling part 84*a* of the pole piece 84. Also, in the metal sleeve 80, the inside diameter of the cylinder part 82 is gradually changed by providing the cylinder part 82 with the taper part 82*c*. As a result, there was also a problem of increasing a manufacturing cost.

An object of the invention is to provide a magnetron and a microwave utilization device capable of preventing performance degradation of the magnetron itself by preventing a cylinder part of a metal sleeve from sinking toward a falling part of a pole piece even when subjected to a high pressure in the case of handling or assembly.

Means for Solving the Problem

The invention provides a magnetron including: an anode cylinder which has a cylindrical shape with both ends opened and which includes a plurality of vanes radially provided on an inner wall surface thereof; a pair of pole pieces positioned in openings of the both ends of the anode cylinder; and metal sleeves which are positioned outside the pair of pole pieces and configured to air-tightly seal the anode cylinder and each of which includes a cylinder part, a flange part continuous with the cylinder part, and a plurality of protrusions provided on a portion in which the cylinder part continues with the flange part.

By the configuration described above, sinking of the cylinder part of the metal sleeve in a recess of the pole piece can be decreased since deformation of the portion in which the cylinder part of the metal sleeve continues with the flange part becomes small even when subjected to an external force in the case of handling or assembly of the magnetron.

In the magnetron, an inside diameter D1 of the cylinder part of the metal sleeve is constant over an entire length of the cylinder part of the metal sleeve.

According to the configuration described above, the inside diameter D1 of the cylinder part of the metal sleeve can be made smaller than an inside diameter of a cylinder part of a metal sleeve of a related-art magnetron. As a result, an annular magnet can be decreased and the lower-cost annular magnet can be used.

In the magnetron, the inside diameter D1 of the cylinder part of the metal sleeve is smaller than an inside diameter D2 of a falling part of the pole piece.

In the magnetron, the pole piece includes a flat surface part contacting a lower surface of the metal sleeve, a funnel-shaped part continuous with the flat surface part, and a plurality of projections which define a same flat surface together with the flat surface part and which are formed by cutting and raising the funnel-shaped part, and the plurality of projections and the flat surface part contact the lower surface of the metal sleeve.

By the configuration described above, the projections of the pole piece can support the flange part of the metal sleeve even when the inside diameter D1 of the cylinder part of the metal sleeve is smaller than the inside diameter D2 of the falling part of the pole piece.

In the magnetron, the pole piece includes a flat surface part contacting a lower surface of the metal sleeve, a funnel-shaped part continuous with the flat surface part, and a nonmagnetic structure which defines a same flat surface together with the flat surface part and which are joined to the funnel-shaped part, and the same flat surface defined by the flat surface part and the nonmagnetic structure contacts the lower surface of the metal sleeve.

By the configuration described above, the nonmagnetic structure can support the flange part of the metal sleeve even when the inside diameter D1 of the cylinder part of the metal sleeve is smaller than the inside diameter D2 of the falling part of the pole piece.

Also, the invention provides a microwave utilization device including the magnetron.

Advantages of the Invention

According to the magnetron and the microwave utilization device according to the invention, performance degradation of the magnetron can be prevented by preventing the cylinder part of the metal sleeve from sinking in the falling part of the pole piece even when subjected to a high pressure in the case of handling or assembly.

DETAILED DESCRIPTION OF THE PREFERRED EMBODIMENTS

An embodiment of the invention will hereinafter be described with reference to the drawings.

(First Embodiment)

Figure 1:
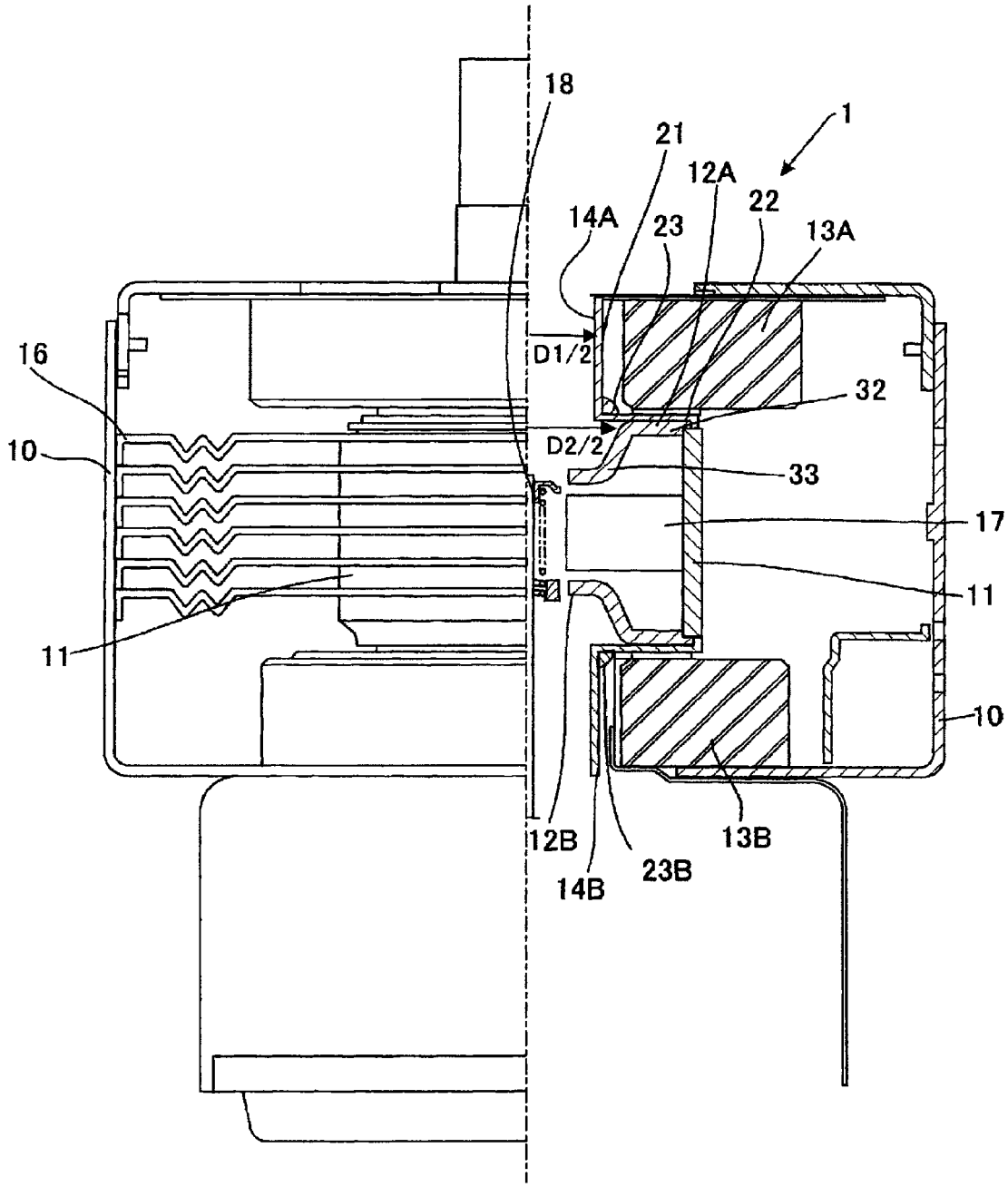
FIG. 1 is a sectional view of a magnetron 1 of an embodiment of the invention.

FIG. 1 is a sectional view of a magnetron 1 of an embodiment of the invention. As shown in FIG. 1, the magnetron 1 according to the present embodiment includes a magnetic yoke 10, an anode cylinder 11, a pole piece 12A inserted into an upper end opening of the anode cylinder 11, a pole piece 12B inserted into a lower end opening of the anode cylinder 11, a metal sleeve 14A of the output side air-tightly coupled to the upper end opening of the anode cylinder 11, the metal sleeve 14A with which the pole piece 12A is covered, a metal sleeve 14B of the input side air-tightly coupled to the lower end opening of the anode cylinder 11, the metal sleeve 14B with which the pole piece 12B is covered, a doughnut-shaped annular magnet 13A placed on an upper surface of the inside of the magnetic yoke 10 so as to be inserted into the metal sleeve 14A of the output side just over the anode cylinder 11, and a doughnut-shaped annular magnet 13B placed on a lower surface of the inside of the magnetic yoke 10 so as to be inserted into the metal sleeve 14B of the input side just under the anode cylinder 11.

As shown in FIG. 1, a plurality of cooling fins 16 are fitted into an outer peripheral surface of the anode cylinder 11. A plurality of vanes 17 are radially arranged on an inner peripheral surface of the anode cylinder 11. In addition, only one vane 17 is shown in FIG. 1.

A cathode structural body 18 is arranged in the center of the anode cylinder 11. Space surrounded by the cathode structural body 18 and the vanes 17 forms an active space inside the anode cylinder 11.

The pole piece 12A and the pole piece 12B are formed in a funnel shape by squeezing processing etc. of a plate material of a magnetic body with low magnetic resistance such as iron. Referring to FIG. 1, the pole piece 12A formed in the funnel shape includes a first flat surface part 32 contacting a lower surface of a flange part of the metal sleeve 14A of the output side described below, and a funnel-shaped part 33 continuous with the first flat surface part 32.

Also, a falling part (the portion in which the first flat surface part 32 continues with the funnel-shaped part 33) formed in the funnel shape of the pole piece 12A has an inside diameter D2 from the central axis as shown in FIG. 1. The inside diameter D2 of the falling part of the pole piece 12A is set larger than an inside diameter D1 of a cylinder part 21 of the metal sleeve 14A of the output side described below.

The metal sleeve 14A of the output side includes the cylinder part 21, a flange part 22 and a plurality of protrusions (ribs) 23. As compared with a configuration of the metal sleeve 80 of the magnetron 90 of the related art, the cylinder part 21 of the metal sleeve 14A of the output side in the embodiment corresponds to the cylinder part 82 of the metal sleeve 80 of the magnetron 90 of the related art.

In addition, the metal sleeve 14A of the output side has a folded-back part (not shown) which continues with the cylinder part 21 and is folded back toward the inside of the metal sleeve 14A itself of the output side like the related art.

Figure 2:
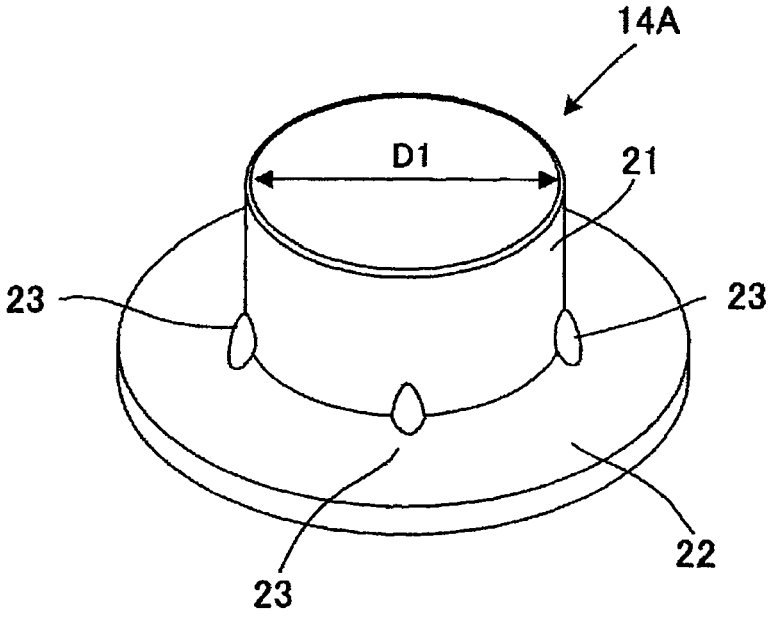
FIG. 2 is a perspective view of a cylinder part and a flange part of a metal sleeve 14A of the output side in the embodiment of the invention.

Next, a configuration of the metal sleeve 14A of the output side of the magnetron 1 will be described with reference to FIG. 2. FIG. 2 is a perspective view of the cylinder part and the flange part of the metal sleeve 14A of the output side in the first embodiment. In addition, the metal sleeve 14B of the input side has the same configuration as the metal sleeve 14A of the output side of the magnetron 1, so that the explanation is omitted.

As shown in FIG. 2, the metal sleeve 14A of the output side includes the cylinder part 21 having the same central axis as the central axis of the anode cylinder 11, the flange part 22 and the plurality of protrusions (ribs) 23.

The cylinder part 21 of the metal sleeve 14A of the output side has the same central axis as the central axis of the anode cylinder 11, and the inside diameter of the cylinder part 21 is D1. Also, the cylinder part 21 has the constant inside diameter D1 over the entire length of the cylinder part 21. Also, the inside diameter D1 of the cylinder part 21 of the metal sleeve 14A of the output side is set smaller than the dimension D2 of the falling part of the pole piece 12A.

The flange part 22 of the metal sleeve 14A of the output side is air-tightly coupled to the anode cylinder 11 at the outer peripheral end of the flange part 22.

The protrusions (ribs) 23 of the metal sleeve 14A of the output side are formed on an outer peripheral surface (side of the annular magnet 13A) of the portion in which the cylinder part 21 of the metal sleeve 14A of the output side continues with the flange part 22 of the metal sleeve 14A of the output side. The portion in which the cylinder part 21 of the metal sleeve 14A of the output side continues with the flange part 22 of the metal sleeve 14A of the output side is, in other words, the portion in which the cylinder part 21 rises from the flange part 22 of the metal sleeve 14A of the output side.

By providing the protrusions (ribs) 23 on the outer peripheral surface of the portion in which the cylinder part 21 continues with the flange part 22 in the metal sleeve 14A of the output side as described above, strength of the cylinder part 21 of the metal sleeve 14A of the output side increases. As a result, the magnetron 1 according to the embodiment can prevent the cylinder part 21 from sinking in the falling part of the pole piece 12A even when subjected to an external force in the case of handling or assembly of the magnetron 1 and an external force after the assembly. Therefore, basic characteristics of the magnetron 1 according to the embodiment can be prevented from degrading.

According to the magnetron 1 according to the embodiment, the cylinder part 21 of the metal sleeve 14A of the output side is not pushed into the side formed in the funnel shape of the pole piece 12A even when subjected to the external force in the case of handling or assembly of the magnetron 1 and the external force after the assembly. Further, deformation of the flange part 22 of the metal sleeve 14A of the output side becomes small, so that basic performance of the magnetron 1 becomes resistant to degradation. Also, the cylinder part 21 of the metal sleeve 14A of the output side has the same inside diameter with respect to the central axis of the anode cylinder 11, so that cost can be reduced.

Also, according to the magnetron 1 according to the embodiment, the magnetron in which variations in basic characteristics of the magnetron 1 are reduced can be provided at low cost. Further, a low-cost microwave utilization device with high reliability can be obtained by using the magnetron 1 according to the embodiment.

In addition, instead of the protrusions (ribs) 23 provided on the flange part 22 of the metal sleeve 14A of the output side, the protrusions (ribs) may be formed on an inner peripheral surface (side of the pole piece 12A) of the portion in which the cylinder part 21 of the metal sleeve 14A of the output side continues with the flange part 22. The inner peripheral surface (side of the pole piece 12A) of the portion in which the cylinder part 21 of the metal sleeve 14A of the output side continues with the flange part 22 does not include a surface of contact between the flange part 22 and the pole piece 12A. The protrusions (ribs) 23 are not provided on the surface of contact between the flange part 22 and the pole piece 12A.

In addition, a position of the protrusion (rib) 23 of the metal sleeve 14A of the output side is not particularly limited as long as the position is in the outer peripheral surface of the portion in which the cylinder part 21 of the metal sleeve 14A of the output side continues with the flange part 22 of the metal sleeve 14A of the output side.

In addition, the protrusions (ribs) 23 provided on the side of the annular magnet 13A in the portion in which the cylinder part 21 of the metal sleeve 14A of the output side continues with the flange part 22 may be extended to the vicinity of an outer peripheral part of the flange part 22 of the metal sleeve 14A of the output side.

(Modified Example)

Figure 3:
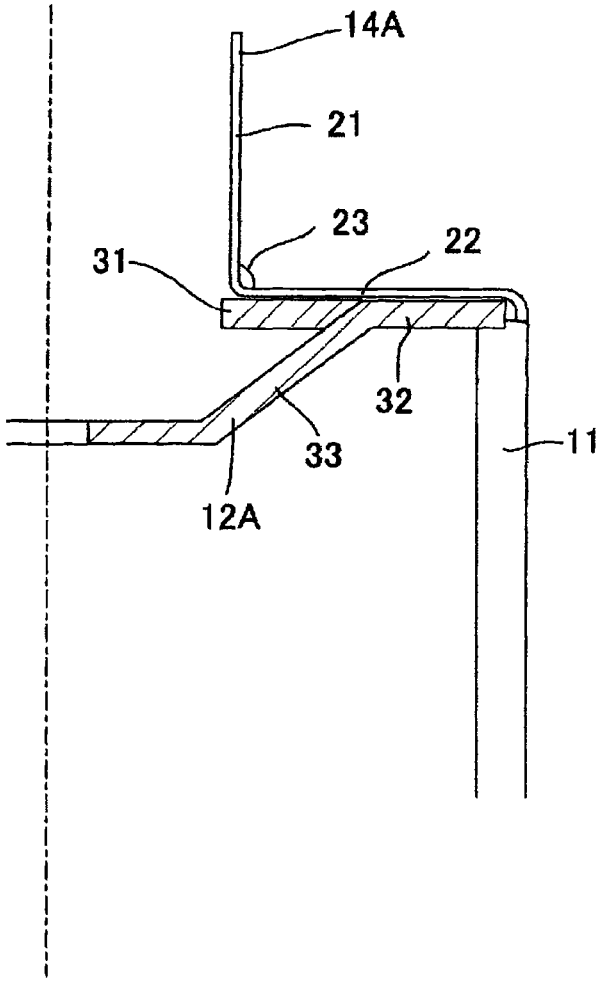
FIG. 3 is a partially sectional view of a modified example of the magnetron 1.
Figure 4:
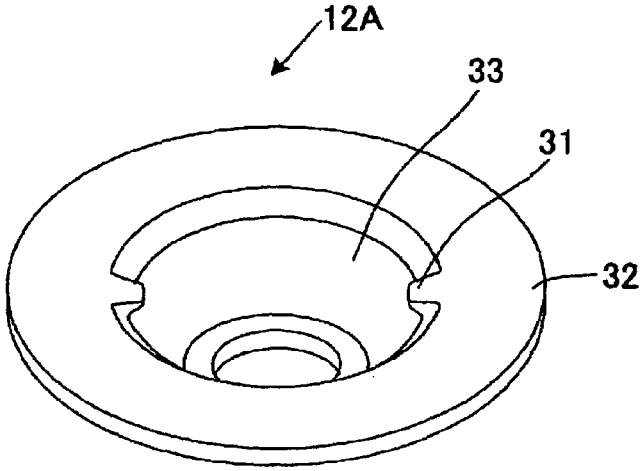
FIG. 4 is a perspective view of a pole piece 12A of the modified example of the magnetron 1.
Figure 5:
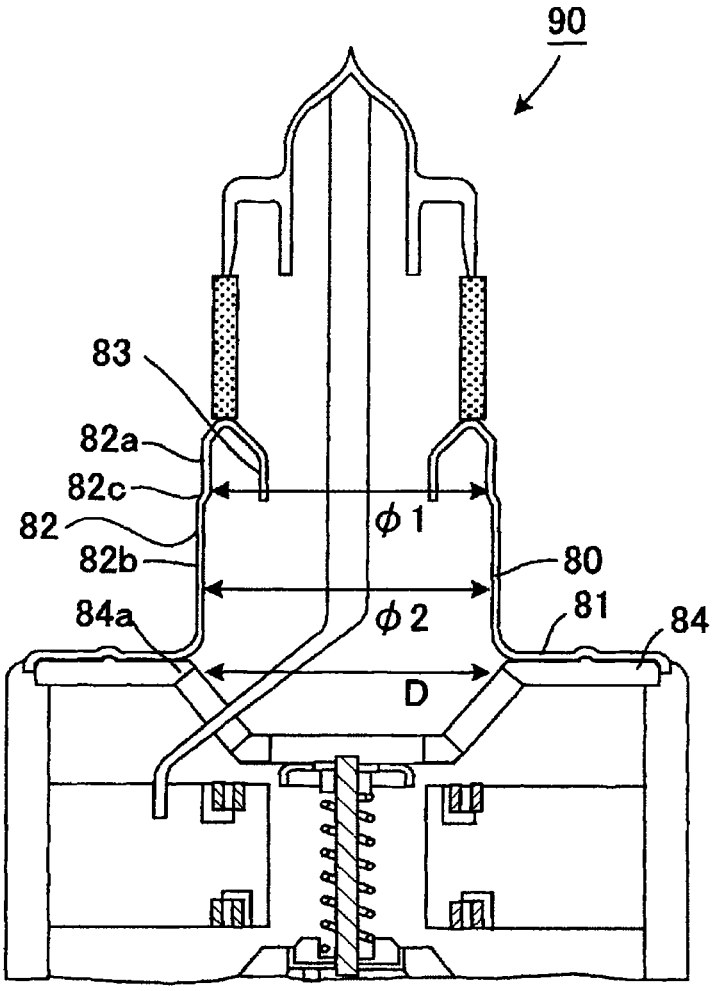
FIG. 5 Prior Art
FIG. 5 is a diagram showing a metal sleeve 80 of a magnetron 90 in related art.

Next, a modified example of the magnetron 1 according to the embodiment will be described. The modified example of the magnetron 1 differs from the magnetron 1 according to the first embodiment in a configuration of a pole piece. A configuration of a pole piece 12A in the modified example of the magnetron 1 will be described with reference to FIGS. 3 and 4. FIG. 3 is a partially sectional view of the modified example of the magnetron 1. FIG. 4 is a perspective view of the pole piece 12A of the modified example of the magnetron 1. In addition, a pole piece 12B has the same configuration as the pole piece 12A, so that the explanation is omitted.

Referring to FIGS. 3 and 4, the pole piece 12A formed in a funnel shape includes a plurality of projections 31, a flat surface part 32, and a funnel-shaped part 33 continuous with the flat surface part 32. Referring to FIG. 3, an upper surface of the flat surface part 32 contacts a lower surface of a flange part 22 of a metal sleeve 14A of the output side. Also, referring to FIG. 4, the plurality of projections 31 formed by cutting and raising the funnel-shaped part 33 of the pole piece 12A define a same flat surface together with the flat surface part 32, and upper surfaces of the projections 31 contacts the lower surface of the flange part 22 of the metal sleeve 14A of the output side. At least a cylinder part 21 of the metal sleeve 14A of the output side is positioned over the plurality of projections 31. As a result, the plurality of projections 31 can prevent the cylinder part 21 of the metal sleeve 14A of the output side from sinking toward a falling part of the pole piece 12A.

According to the modified example of the magnetron 1 according to the embodiment, the cylinder part 21 of the metal sleeve 14A of the output side is reinforced with the plurality of projections 31 contact the lower surface of the flange part 22 of the metal sleeve 14A of the output side. As a result, the cylinder part 21 of the metal sleeve 14A of the output side is not pushed into the side formed in the funnel shape of the pole piece 12A even when subjected to an external force in the case of handling or assembly of the magnetron and an external force after the assembly. Further, deformation of the flange part 22 becomes small, so that basic performance of the magnetron becomes resistant to degradation. Also, the cylinder part 21 of the metal sleeve 14A of the output side has the same inside diameter with respect to the central axis of an anode cylinder 11, so that cost can be reduced.

In addition, in the modified example of the magnetron 1 according to the embodiment, the projections 31 are formed by cutting and raising the funnel-shaped part 33 of the pole piece 12A, but are not limited to this. For example, the same flat surface with the flat surface part 32 may be defined by joining a nonmagnetic structure different from the pole piece 12A to the funnel-shaped part 33 without cutting and raising the funnel-shaped part 33 of the pole piece 12A and may contact a lower surface of the metal sleeve 14A of the output side.

By the configuration described above, the nonmagnetic structure can support the flange part of the metal sleeve even when an inside diameter D1 of the cylinder part of the metal sleeve is smaller than an inside diameter D2 of the falling part of the pole piece. Also, by the configuration described above, an influence on a magnetic circuit constructed of the pole piece 12A, an annular magnet 13A and a magnetic yoke 10 can be minimized.

The invention has been described in detail with reference to the specific embodiment, but it is apparent to those skilled in the art that various changes or modifications can be made without departing from the spirit and scope of the invention.

The present application is based on Japanese patent application (Patent Application No. 2009-046643) filed on Feb. 27, 2009, and the contents of the patent application are hereby incorporated by reference.

Industrial Applicability

A magnetron and a microwave utilization device according to the invention have an effect of providing the low-cost magnetron for preventing deformation of a metal sleeve of the magnetron and preventing degradation of basic characteristics, and are useful as the microwave utilization device such as a microwave oven.

The invention claimed is:

1. A magnetron comprising:

an anode cylinder which has a cylindrical shape with both ends opened and which comprises a plurality of vanes radially provided on an inner wall surface thereof;

a pair of pole pieces positioned in openings of the both ends of the anode cylinder;

metal sleeves which are positioned outside the pair of pole pieces and configured to air-tightly seal the anode cylinder, and each of which comprises a cylinder part, a flange part continuous with the cylinder part, and a plurality of protrusions provided on a portion in which the cylinder part continues with the flange part; and a doughnut-shaped annular magnet placed on the flange part of each metal sleeve and spaced apart from the cylinder part of each metal sleeve;

wherein the plurality of protrusions are arranged in a space between the cylinder part of each metal sleeve and the magnet and the flange part comprises an upper surface facing the magnet and a lower surface facing the pole pieces, wherein the protrusions are arranged at the junction of the cylinder part and the flange part of each metal sleeve and do not contact the magnet.

2. The magnetron according to claim 1, wherein an inside diameter D1 of the cylinder part of the metal sleeve is constant over an entire length of the cylinder part of the metal sleeve.

3. The magnetron according to claim 1, wherein the inside diameter D1 of the cylinder part of the metal sleeve is smaller than an inside diameter D2 of a falling part of the pole piece.

4. The magnetron according to claim 3, wherein the pole piece comprises: a flat surface part contacting the lower surface of the metal sleeve; a funnel-shaped part continuous with the flat surface part; and a plurality of projections which define a same flat surface together with the flat surface part and which are formed by cutting and raising the funnel-shaped part, and wherein the plurality of projections and the flat surface part contact the lower surface of the metal sleeve.

5. The magnetron according to claim 3, wherein the pole piece includes a flat surface part contacting the lower surface of the metal sleeve, a funnel-shaped part continuous with the flat surface part, and a nonmagnetic structure which defines a same flat surface together with the flat surface part and which are joined to the funnel-shaped part, and wherein the same flat surface defined by the flat surface part and the nonmagnetic structure contacts the lower surface of the metal sleeve.

* * * * *